US010450878B2

(12) United States Patent
Baumann

(10) Patent No.: US 10,450,878 B2
(45) **Date of Patent: *Oct. 22, 2019**

(54) SEGMENTED STATOR ASSEMBLY

(71) Applicant: United Technologies Corporation, Farmington, CT (US)

(72) Inventor: Paul W. Baumann, Amesbury, MA (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 499 days.

This patent is subject to a terminal disclaimer.

(21) Appl. No.: 15/203,325

(22) Filed: Jul. 6, 2016

(65) Prior Publication Data

US 2018/0010472 A1 Jan. 11, 2018

(51) Int. Cl.
*F01D 9/04* (2006.01)
*F01D 5/30* (2006.01)
(Continued)

(52) U.S. Cl.
CPC ..... *F01D 9/041* (2013.01); *F01D 5/3023* (2013.01); *F01D 9/042* (2013.01); *F01D 25/06* (2013.01); *F04D 29/542* (2013.01); *F04D 29/668* (2013.01); *F05D 2220/32* (2013.01); *F05D 2240/12* (2013.01); *F05D 2240/14* (2013.01);
(Continued)

(58) Field of Classification Search
CPC ..... F01D 9/041; F01D 9/042; F05D 2260/96
See application file for complete search history.

(56) References Cited

U.S. PATENT DOCUMENTS 3,867,066 A 2/1975 Canova et al.
4,832,568 A 5/1989 Roth et al.
(Continued)

FOREIGN PATENT DOCUMENTS

EP 0811753 A1 12/1997
EP 1079075 A2 2/2001
(Continued)

OTHER PUBLICATIONS

European Search Report Issued in EP Application No. 17180138.4, dated Nov. 16, 207, 8 Pages.
(Continued)

*Primary Examiner* — Ninh H. Nguyen
(74) *Attorney, Agent, or Firm* — Cantor Colburn LLP

(57) ABSTRACT

A stator assembly for a gas turbine engine includes an arcuate outer shroud, an arcuate inner shroud radially spaced from the outer shroud and a plurality of stator vanes extending from the outer shroud to the inner shroud. A volume of potting is located at the inner shroud and at the outer shroud to retain the plurality of stator vanes thereat. A stator and case assembly includes a case defining a working fluid flowpath and a stator assembly positioned at the case. The stator assembly includes a plurality of stator segments arranged circumferentially about an engine axis, each stator segment including an arcuate outer shroud secured to the case, an arcuate inner shroud, and a plurality of stator vanes extending from the outer to inner shroud. A volume of potting is located at the inner shroud and at the outer shroud to retain the plurality of stator vanes thereat.

15 Claims, 2 Drawing Sheets

(51) Int. Cl.
*F01D 25/06* (2006.01)
*F04D 29/54* (2006.01)
*F04D 29/66* (2006.01)

(52) U.S. Cl.
CPC ..... *F05D 2260/30* (2013.01); *F05D 2260/96* (2013.01); *F05D 2300/43* (2013.01)

(56) References Cited

U.S. PATENT DOCUMENTS 4,940,386 A * 7/1990 Feuvrier ..... F01D 9/04 415/189
5,074,752 A 12/1991 Murphy et al.
5,494,404 A 2/1996 Furseth et al.
6,595,747 B2 * 7/2003 Bos ..... F01D 9/042 415/209.2
7,086,831 B2 * 8/2006 Harper ..... F01D 5/26 415/209.3
7,311,495 B2 * 12/2007 Ashley ..... F01D 5/26 415/209.4
8,672,623 B2 * 3/2014 Harper ..... F01D 9/042 415/209.2
9,097,124 B2 * 8/2015 Dube ..... F01D 5/16
2013/0205800 A1 * 8/2013 Ivakitch ..... F01D 9/042 60/805
2013/0251517 A1 9/2013 Ivakitch et al.
2014/0356158 A1 12/2014 Barnett

FOREIGN PATENT DOCUMENTS

EP 1213484 A1 6/2002
EP 1741878 A2 1/2007
EP 2204539 A2 7/2010
EP 2239421 A2 10/2010
EP 2479383 A2 7/2012
EP 2620591 A2 7/2013
GB 865544 A 4/1961

OTHER PUBLICATIONS

European Office Action Issued in EP Application No. 17 180 138.4; dated May 15, 2019; 56 Pages.

* cited by examiner

SEGMENTED STATOR ASSEMBLY

BACKGROUND

This disclosure relates to gas turbine engines, and more particularly to stator vane arrangements for gas turbine engines.

A gas turbine engine typically includes a rotor assembly which extends axially through the engine. A stator assembly is radially spaced from the rotor assembly and includes an engine case which circumscribes the rotor assembly. A flow path for working medium gasses is defined within the case and extends generally axially between the stator assembly and the rotor assembly.

The rotor assembly includes an array of rotor blades extending radially outwardly across the working medium flowpath into proximity with the case. Arrays of stator vane assemblies are alternatingly arranged between rows of rotor blades and extend inwardly from the case across the working medium flowpath into proximity with the rotor assembly to guide the working medium gases when discharged from the rotor blades. Some stator vane assemblies, such as those located between adjacent low pressure compressor or fan rotors, include an outer shroud fixed to a casing and a plurality of stator vanes along with an inner shroud cantilevered off of the outer shroud.

The stator vanes are rigidly fixed to the inner shroud and outer shroud and are thus configured with aeromechanical tuning of vibratory modes, which often results in the vane deviating from an optimal aerodynamic shape.

SUMMARY

In one embodiment, a stator assembly for a gas turbine engine includes an arcuate outer shroud, an arcuate inner shroud radially spaced from the outer shroud and a plurality of stator vanes extending from the outer shroud to the inner shroud. A volume of potting is located at the inner shroud and at the outer shroud to retain the plurality of stator vanes thereat.

Additionally or alternatively, in this or other embodiments each stator vane of the plurality of stator vanes includes an airfoil portion, an outer leg extending radially outwardly from the airfoil portion, and an inner leg extending radially inwardly from the airfoil portion.

Additionally or alternatively, in this or other embodiments the outer leg is installed into an outer shroud opening in the outer shroud, and the inner leg is installed into an inner shroud opening in the inner shroud.

Additionally or alternatively, in this or other embodiments the potting includes an outer grommet located at each outer shroud opening and an inner grommet located at each inner shroud opening to retain each stator vane thereat.

Additionally or alternatively, in this or other embodiments each stator vane further includes an outer leg opening and an inner leg opening. A retention element extends through each inner leg opening and/or each outer leg opening to secondarily retain the plurality of stator vanes at the inner shroud and/or the outer shroud.

Additionally or alternatively, in this or other embodiments the potting compound at least partially fills an outer shroud channel and/or an inner shroud channel.

Additionally or alternatively, in this or other embodiments the plurality of stator vanes is formed from a first material and the outer shroud and/or the inner shroud are formed from a second material different than the first material.

Additionally or alternatively, in this or other embodiments the plurality of stator vanes are formed from a composite material.

Additionally or alternatively, in this or other embodiments the potting is a rubber material.

In another embodiment, a stator and case assembly for a gas turbine engine includes a case defining a working fluid flowpath for the gas turbine engine, and a stator assembly positioned at the case. The stator assembly includes a plurality of stator segments arranged circumferentially about an engine axis, each stator segment including an arcuate outer shroud secured to the case, an arcuate inner shroud radially spaced from the outer shroud, and a plurality of stator vanes extending from the outer shroud to the inner shroud. A volume of potting is located at the inner shroud and at the outer shroud to retain the plurality of stator vanes thereat.

Additionally or alternatively, in this or other embodiments each stator vane of the plurality of stator vanes includes an airfoil portion, an outer leg extending radially outwardly from the airfoil portion, and an inner leg extending radially inwardly from the airfoil portion.

Additionally or alternatively, in this or other embodiments the outer leg is installed into an outer shroud opening in the outer shroud, and the inner leg is installed into an inner shroud opening in the inner shroud.

Additionally or alternatively, in this or other embodiments the potting includes an outer grommet located at each outer shroud opening and an inner grommet located at each inner shroud opening to retain each stator vane thereat.

Additionally or alternatively, in this or other embodiments each stator vane further includes an outer leg opening and an inner leg opening. A retention element extends through each inner leg opening and/or each outer leg opening to secondarily retain the plurality of stator vanes at the inner shroud and/or the outer shroud.

Additionally or alternatively, in this or other embodiments the potting compound at least partially fills an outer shroud channel and/or an inner shroud channel.

Additionally or alternatively, in this or other embodiments the plurality of stator vanes is formed from a first material and the outer shroud and/or the inner shroud are formed from a second material different than the first material.

Additionally or alternatively, in this or other embodiments the plurality of stator vanes are formed from a composite material.

Additionally or alternatively, in this or other embodiments the potting is a rubber material.

In yet another embodiment, a gas turbine engine includes a combustor and a stator and case assembly in in fluid communication with the combustor. The stator and case assembly includes a case defining a working fluid flowpath for the gas turbine engine and a stator assembly located at the case. The stator assembly includes a plurality of stator segments arranged circumferentially about an engine axis, each stator segment including an arcuate outer shroud secured to the case, an arcuate inner shroud radially spaced from the outer shroud, a plurality of stator vanes extending from the outer shroud to the inner shroud, and a volume of potting located at the inner shroud and at the outer shroud to retain the plurality of stator vanes thereat.

Additionally or alternatively, in this or other embodiments each stator vane of the plurality of stator vanes includes an airfoil portion, an outer leg extending radially outwardly from the airfoil portion and into an outer shroud opening in the outer shroud and an inner leg extending radially inwardly from the airfoil portion and into an inner shroud opening in the inner shroud.

BRIEF DESCRIPTION OF THE DRAWINGS

The subject matter which is regarded as the present disclosure is particularly pointed out and distinctly claimed in the claims at the conclusion of the specification. The foregoing and other features, and advantages of the present disclosure are apparent from the following detailed description taken in conjunction with the accompanying drawings in which:

DETAILED DESCRIPTION

Figure 1:
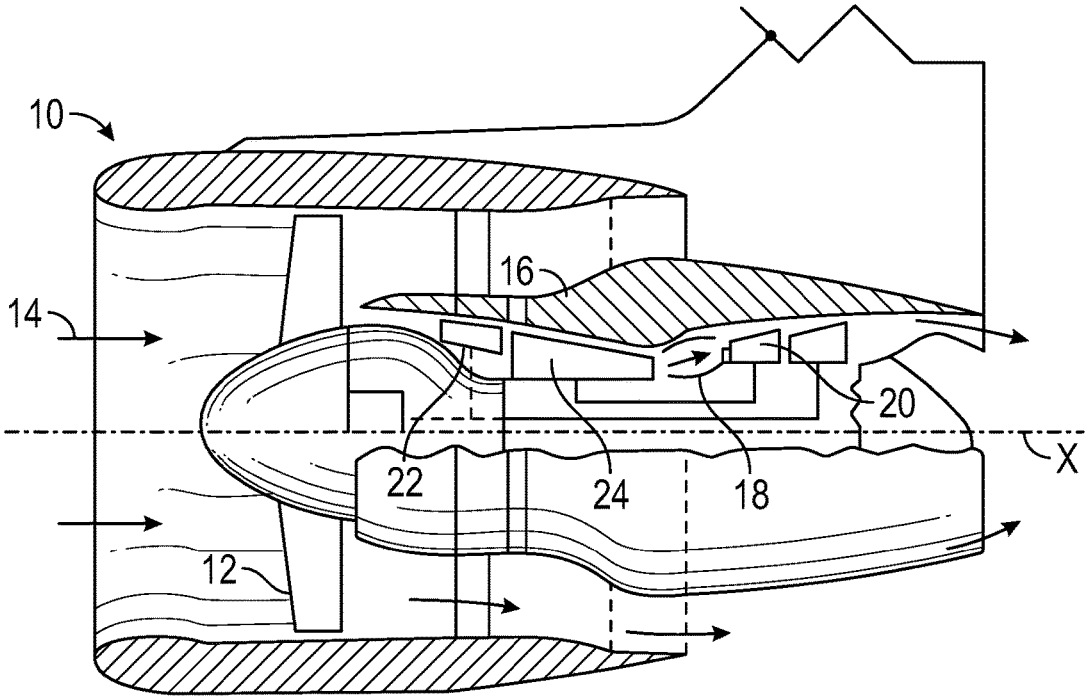
FIG. 1 is a schematic illustration of a gas turbine engine.

FIG. 1 is a schematic illustration of a gas turbine engine 10. The gas turbine engine generally has a fan 12 through which ambient air is propelled in the direction of arrow 14, a compressor 16 for pressurizing the air received from the fan 12 and a combustor 18 wherein the compressed air is mixed with fuel and ignited for generating combustion gases.

The gas turbine engine 10 further comprises a turbine section 20 for extracting energy from the combustion gases. Fuel is injected into the combustor 18 of the gas turbine engine 10 for mixing with the compressed air from the compressor 16 and ignition of the resultant mixture. The fan 12, compressor 16, combustor 18, and turbine 20 are typically all concentric about a common central longitudinal axis of the gas turbine engine 10.

The gas turbine engine 10 may further comprise a low pressure compressor 22 located upstream of a high pressure compressor 24 and a high pressure turbine located upstream of a low pressure turbine. For example, the compressor 16 may be a multi-stage compressor 16 that has a low-pressure compressor 22 and a high-pressure compressor 24 and the turbine 20 may be a multistage turbine 20 that has a high-pressure turbine and a low-pressure turbine. In one embodiment, the low-pressure compressor 22 is connected to the low-pressure turbine and the high pressure compressor 24 is connected to the high-pressure turbine.

Figure 2:
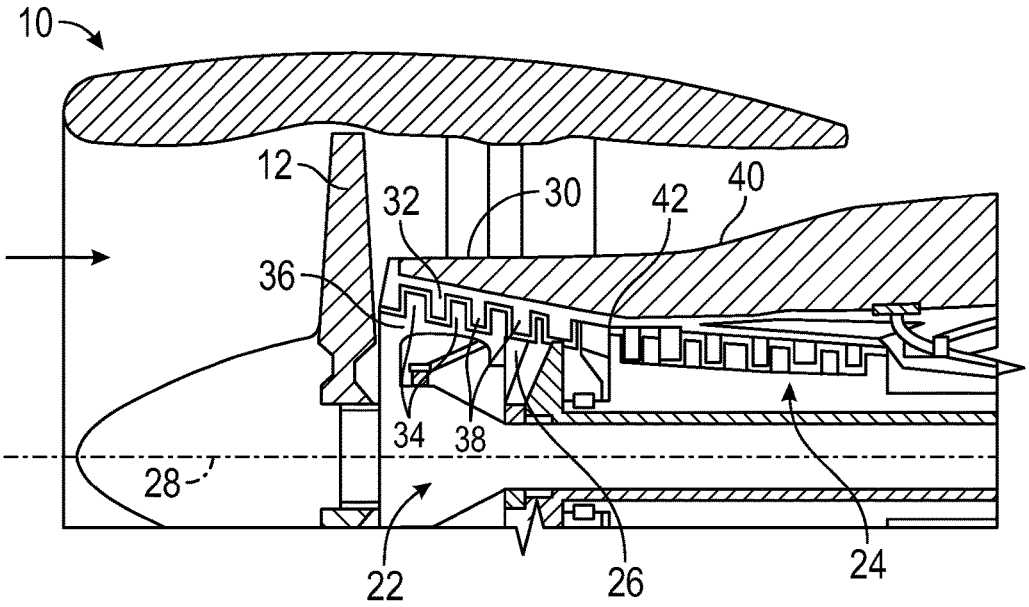
FIG. 2 is a schematic illustration of a low pressure compressor section of a gas turbine engine.

Referring now to FIG. 2, the low pressure compressor (LPC) 22 includes an LPC case 30 with one or more LPC rotors 26 located in the LPC case 30 and rotatable about an engine axis 28. One or more LPC stators 32 are located axially between successive LPC rotors 26. Each LPC rotor 26 includes a plurality of rotor blades 34 extending radially outwardly from a rotor disc 36, while each LPC stator 32 includes a plurality of stator vanes 38 extending radially inwardly from the LPC case 30. The LPC 22 further includes an intermediate case 40 located axially downstream from the LPC case 30 and is utilized to direct airflow 14 from the LPC 22 to the high pressure compressor 24. An exit stator 42 is located in the intermediate case 40.

Figure 3:
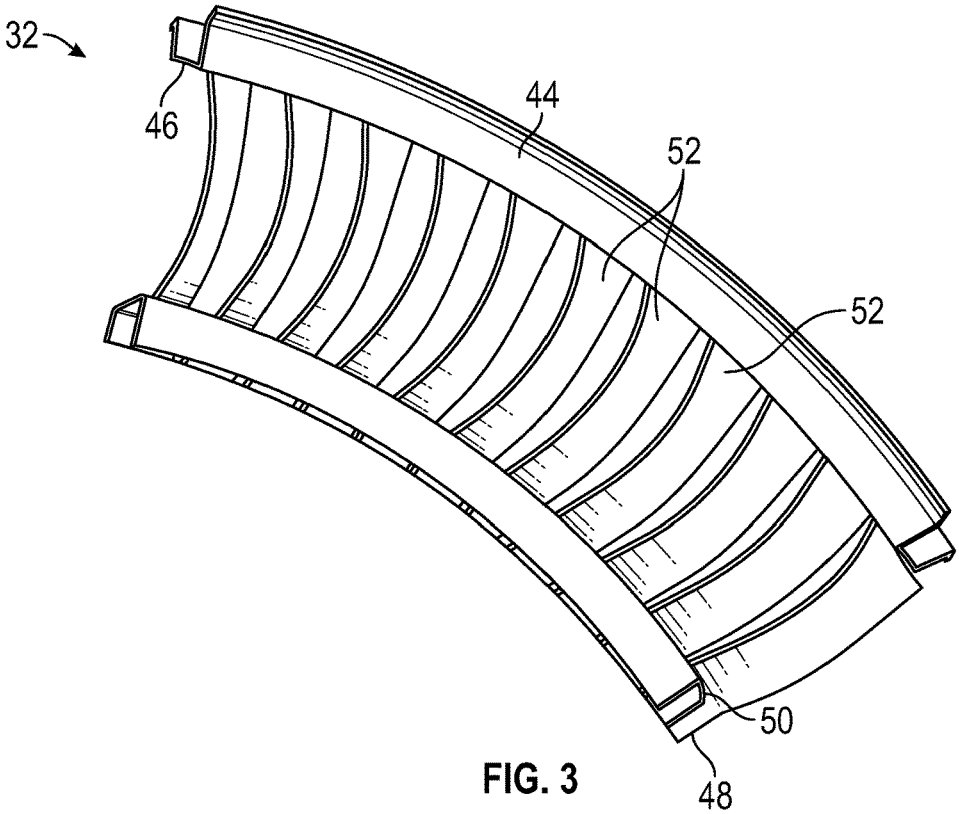
FIG. 3 is a perspective view of an embodiment of a stator assembly of a gas turbine engine.

While the following description is in the context of an LPC stator 32, one skilled in the art will readily appreciated that the present disclosure may be readily applied to other stator assemblies configured as segmented stators. Referring now to FIG. 3, the LPC stator 32 is a segmented stator, with each LPC stator 32 extending partially circumferentially about the engine axis 28. For example, in some embodiments 6, 8, 10 or 12 LPC stators 32 may be placed circumferentially adjacently to complete an LPC stator assembly about the engine axis 28. Each LPC stator 32 includes an outer shroud 44 fixed to the LPC case 30 and defining an outer flowpath surface 46. The LPC stator 32 similarly includes an inner shroud 48 radially spaced from the outer shroud 44 and defining an inner flowpath surface 50. In some embodiments, the outer shroud 44 and the inner shroud 48 are formed from metallic materials, for example, an aluminum material or alternatively a composite material such as a thermoplastic polyetherimide material. A plurality of stator vanes 52 extend between the outer shroud 44 and the inner shroud 48. In some embodiments, the stator vanes 52 are formed from a metal material or from a composite material such as an epoxy resin impregnated carbon material.

Figure 4:
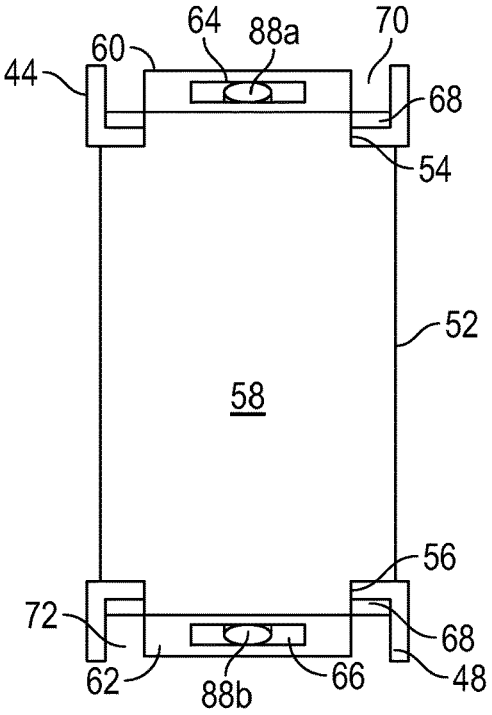
FIG. 4 is a cross-sectional view of an embodiment of a stator assembly.

Referring now to FIG. 4, the outer shroud 44 includes a plurality of outer shroud openings 54 spaced circumferentially along the outer shroud 44 and the inner shroud 48 includes a plurality of inner shroud openings 56 spaced circumferentially along the inner shroud 48. Each stator vane 52 includes an airfoil portion 58, with an outer leg 60 extending radially outwardly from the airfoil portion 58 and an inner leg 62 extending radially inwardly from the airfoil portion 58. At assembly of the exit stator 42, the outer leg 60 of each stator vane 52 is inserted into an outer shroud opening 54 and the inner leg 62 of each stator vane 52 is inserted into an inner shroud opening 56.

The stator vanes 52 are retained at the outer shroud 44 and the inner shroud 48 via a volume of potting material 68 at the outer shroud 44 and at the inner shroud 48. In some embodiments, the potting material 68 is a rubber or other elastomeric material. In some embodiments, the potting material 68 at least partially fills an outer shroud channel 70 at the outer shroud 44 into which the outer leg 60 extends. Further, in some embodiments the potting material 68 at least partially fills an inner shroud channel 72 at the inner shroud 48 into which the inner leg 62 extends. The potting material 68 provides a primary retention for the stator vane 52.

In some embodiments, the outer leg 60 includes an outer leg slot 64 and/or the inner leg 62 includes an inner leg slot 66. A secondary retention member, such as a strap 88*a*, is inserted through the outer leg slot 64 to retain the outer leg 60 at the outer shroud 44. Similarly, strap 88*b* is inserted through the inner leg slot 66 to retain the inner leg 62 at the inner shroud 48.

Figure 5:
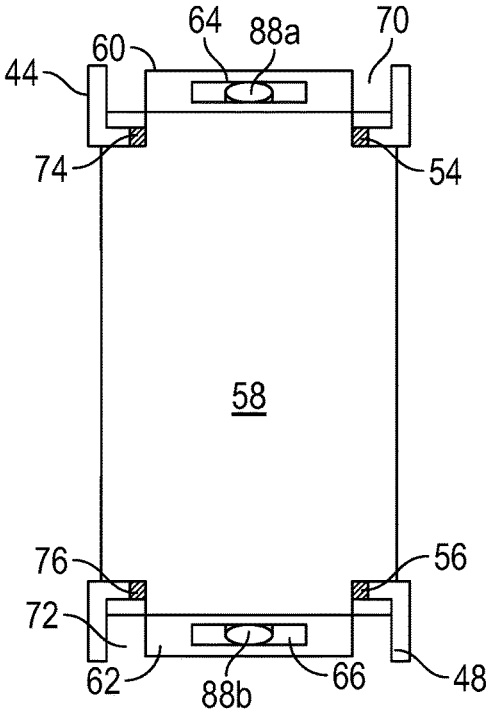
FIG. 5 is a cross-sectional view of another embodiment of a stator assembly.

Referring now to FIG. 5, in some embodiments the potting material is in the form of grommets formed from, for example, a rubber material, installed into the outer shroud 44 and inner shroud 48, respectively. For example, an outer grommet 74 is installed into each outer shroud opening 54 and an inner grommet 76 is installed into each inner shroud opening 56. Once the outer grommets 74 and the inner grommets 76 are installed, the stator vanes 52 are installed into the outer shroud openings 56 and the inner shroud openings 54.

Utilizing potting material as primary retention of the stator vanes at the outer shroud and the inner shroud allows the stator vanes to be formed from a different material than the outer shroud and/or the inner shroud. For example, the stator vanes may be formed from a composite material while the inner and outer shrouds are formed from a metal material resulting in a considerable weight reduction when compared to an all-metal stator assembly. Further, the potting material provides necessary vibrational damping properties allowing the stator assembly in general and the stator vanes in particular to be formed to an aerodynamically optimized shape.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the spirit and scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

The invention claimed is:

1. A stator assembly for a gas turbine engine, comprising:
an arcuate outer shroud;
an arcuate inner shroud radially spaced from the outer shroud;
a plurality of stator vanes extending from the outer shroud to the inner shroud, each of the stator vanes including:
an airfoil portion having a first streamwise width;
an outer leg extending radially outwardly from the airfoil portion, the outer leg having a second streamwise width less than the first streamwise width; and
an inner leg extending radially inwardly from the airfoil portion, the inner leg having a third streamwise width less than the first streamwise width; and
a volume of potting disposed at the inner shroud and at the outer shroud to retain the plurality of stator vanes thereat;
the arcuate outer shroud including:
an axial forward wall;
an axial aft wall; and
a plurality of outer shroud openings in the outer shroud between the axial forward wall and the axial aft wall;
wherein each outer shroud opening of the plurality of outer shroud openings receives a stator vane of the plurality of stator vanes therein;
wherein the axial forward wall and the axial aft wall define an outer shroud channel therebetween, the volume of potting at least partially filling the outer shroud channel wherein the plurality of stator vanes are formed from a composite material.

2. The stator assembly of claim 1, wherein:
the outer leg is installed into an outer shroud opening of the plurality of outer shroud openings; and
the inner leg is installed into an inner shroud opening in the inner shroud.

3. The stator assembly of claim 2, wherein the potting comprises:
an outer grommet disposed at each outer shroud opening; and
an inner grommet disposed at each inner shroud opening to retain each stator vane thereat.

4. The stator assembly of claim 1, wherein each stator vane further includes:
an outer leg opening; and
an inner leg opening;
wherein a retention element extends through each inner leg opening and/or each outer leg opening to secondarily retain the plurality of stator vanes at the inner shroud and/or the outer shroud.

5. The stator assembly of claim 1, wherein the volume of potting at least partially fills an inner shroud channel.

6. The stator assembly of claim 1, wherein the plurality of stator vanes is formed from a first material and the outer shroud and/or the inner shroud are formed from a second material different than the first material.

7. The stator assembly of claim 1, wherein the potting is a rubber material.

8. A stator and case assembly for a gas turbine engine comprising:
a case defining a working fluid flowpath for the gas turbine engine; and
a stator assembly disposed at the case, the stator assembly including a plurality of stator segments arranged circumferentially about an engine axis, each stator segment including:
an arcuate outer shroud secured to the case;
an arcuate inner shroud radially spaced from the outer shroud;
a plurality of stator vanes extending from the outer shroud to the inner shroud, each of the stator vanes including:
an airfoil portion having a first streamwise width;
an outer leg extending radially outwardly from the airfoil portion, the outer leg having a second streamwise width less than the first streamwise width; and
an inner leg extending radially inwardly from the airfoil portion, the inner leg having a third streamwise width less than the first streamwise width; and
a volume of potting disposed at the inner shroud and at the outer shroud to retain the plurality of stator vanes thereat;
the arcuate outer shroud including:
an axial forward wall;
an axial aft wall; and
a plurality of outer shroud openings in the outer shroud between the axial forward wall and the axial aft wall;
wherein each outer shroud opening of the plurality of outer shroud openings receives a stator vane of the plurality of stator vanes therein;
wherein the axial forward wall and the axial aft wall define an outer shroud channel therebetween, the volume of potting at least partially filling the outer shroud channel wherein the plurality of stator vanes are formed from a composite material.

9. The stator and case assembly of claim 8, wherein:
the outer leg is installed into an outer shroud opening of the plurality of outer shroud openings; and
the inner leg is installed into an inner shroud opening in the inner shroud.

10. The stator and case assembly of claim 9, wherein the potting comprises:
an outer grommet disposed at each outer shroud opening; and
an inner grommet disposed at each inner shroud opening to retain each stator vane thereat.

11. The stator and case assembly of claim 8, wherein each stator vane further includes:
an outer leg opening; and
an inner leg opening;

wherein a retention element extends through each inner leg opening and/or each outer leg opening to secondarily retain the plurality of stator vanes at the inner shroud and/or the outer shroud.

12. The stator and case assembly of claim 8, wherein the volume of potting at least partially fills an inner shroud channel.

13. The stator and case assembly of claim 8, wherein the plurality of stator vanes is formed from a first material and the outer shroud and/or the inner shroud are formed from a second material different than the first material.

14. The stator and case assembly of claim 8, wherein the potting is a rubber material.

15. A gas turbine engine, comprising:

a combustor; and a stator and case assembly in fluid communication with the combustor, the stator and case assembly including:

a case defining a working fluid flowpath for the gas turbine engine; and a stator assembly disposed at the case, the stator assembly including a plurality of stator segments arranged circumferentially about an engine axis, each stator segment including:

an arcuate outer shroud secured to the case;

an arcuate inner shroud radially spaced from the outer shroud;

a plurality of stator vanes extending from the outer shroud to the inner shroud, each of the stator vanes including:

an airfoil portion having a first streamwise width;

an outer leg extending radially outwardly from the airfoil portion, the outer leg having a second streamwise width less than the first streamwise width; and an inner leg extending radially inwardly from the airfoil portion, the inner leg having a third streamwise width less than the first streamwise width; and a volume of potting disposed at the inner shroud and at the outer shroud to retain the plurality of stator vanes thereat;

the arcuate outer shroud including:

an axial forward wall;

an axial aft wall; and a plurality of outer shroud openings in the outer shroud between the axial forward wall and the axial aft wall;

wherein each outer shroud opening of the plurality of outer shroud openings receives a stator vane of the plurality of stator vanes therein;

wherein the axial forward wall and the axial aft wall define an outer shroud channel therebetween, the volume of potting at least partially filling the outer shroud channel wherein the plurality of stator vanes are formed from a composite material.

* * * * *